US008081782B2

(12) United States Patent
Klinghult

(10) Patent No.: US 8,081,782 B2
(45) Date of Patent: Dec. 20, 2011

(54) ACOUSTIC-ELECTRIC TRANSDUCER, ELECTRONIC DEVICE, METHOD, AND COMPUTER PROGRAM PRODUCT

(75) Inventor: Gunnar Klinghult, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 888 days.

(21) Appl. No.: 12/121,555

(22) Filed: May 15, 2008

(65) Prior Publication Data

US 2009/0285418 A1 Nov. 19, 2009

(51) Int. Cl.
*H04R 25/00* (2006.01)
*H04R 11/02* (2006.01)

(52) U.S. Cl. ..... 381/162; 381/418

(58) Field of Classification Search ..... 381/337, 381/418, 162, 184; 438/50–53; 257/254, 257/419, E29.324
See application file for complete search history.

(56) References Cited

U.S. PATENT DOCUMENTS

| | | | | |
|---|---|---|---|---|
| 7,132,307 | B2 * | 11/2006 | Wang et al. | 438/53 |
| 7,701,119 | B2 * | 4/2010 | Onishi et al. | 310/328 |
| 2005/0069164 | A1 | 3/2005 | Muthuswamy et al. | |
| 2007/0195976 | A1 | 8/2007 | Sekino et al. | |
| 2008/0212807 | A1 * | 9/2008 | Wang | 381/190 |

FOREIGN PATENT DOCUMENTS

| | | |
|---|---|---|
| GB | 2 081 552 | 2/1982 |
| JP | 05145998 | 6/1993 |
| JP | 2008131326 | 6/2008 |

OTHER PUBLICATIONS

International Search Report and the Written Opinion of the International Searching Authority corresponding to PCT/EP2008/064314, Feb. 11, 2009, 10 pages.

* cited by examiner

*Primary Examiner* — Calvin Lee
(74) *Attorney, Agent, or Firm* — Harrity & Harrity, LLP

(57) ABSTRACT

An acoustic-electric transducer for a microphone may include a cavity delimited by a wall and having an opening; a diaphragm having an outer boundary, said diaphragm extending across said opening so that an air gap is provided transversely outwards of the diaphragm between said outer boundary of said diaphragm and said cavity wall; and an actuator configured to adjust a size of said air gap.

17 Claims, 3 Drawing Sheets

ACOUSTIC-ELECTRIC TRANSDUCER, ELECTRONIC DEVICE, METHOD, AND COMPUTER PROGRAM PRODUCT

TECHNICAL FIELD

Embodiments disclosed herein may relate to an acoustic-electric transducer for a microphone and an electronic device comprising an acoustic-electric transducer. Embodiments disclosed herein may also relate to a method for changing the frequency response of an acoustic-electric transducer and a computer program product.

BACKGROUND

A microphone comprises an acoustic-to-electric transducer or sensor that converts sound into an electric signal. Condenser microphones, also known as capacitor microphones, comprise a diaphragm that acts as one plate of a capacitor and vibrates in response to incoming acoustic signals, or sound pressure, whereby the vibrations produce changes in the distance between the plates and, as a result, the capacitance. According to the equation Q=CV for a capacitor, a change of capacitance, C, may result in a change in voltage, V, if the charge, Q, of the capacitor is kept constant. In this way, an acoustic signal (pressure wave) may be converted to a change of capacitance via the deflection of the diaphragm, which may be converted into an electrical signal which can be amplified or recorded.

In cellular telephones it may be desirable to have a microphone with a frequency response that corresponds to the frequency content of a human speaker's voice, e.g., a frequency response of about 300-3000 Hz, meaning that the microphone may amplify or record frequencies within that range.

In some environments, such as an outdoor environment, sound quality may, however, be adversely affected by background noise, such as by wind that blows into the microphone. Wind noise may increase the low frequency component of the acoustic signal entering the microphone; it can easily overwhelm the voice of a human speaker using the cellular telephone and saturate the microphone's amplifier.

SUMMARY

Embodiments disclosed herein may allow for an improved acoustic-electric transducer for a microphone.

An acoustic-electric transducer for a microphone may include a cavity delimited by a wall and having an opening; a diaphragm arranged to extend across the opening so that an air gap is formed transversely outwards of the diaphragm between the outer boundary of said diaphragm and the cavity wall. The microphone may include an actuator that is arranged to adjust the size of said air gap.

An improved acoustic-electric transducer may be achieved by a acoustic-electric transducer comprising a cavity delimited by a wall/walls and having an opening, and a diaphragm that vibrates in response to incoming acoustic signals. The diaphragm may have an outer boundary and may be arranged to extend across the opening so that an air gap may be provided transversely outwards of the diaphragm between the outer boundary of the diaphragm and the cavity wall/walls. The acoustic-electric transducer may comprise an actuator that may be arranged to adjust the size of the air gap, e.g., the transverse distance between the outer boundary of the diaphragm and the cavity wall/walls.

Such an acoustic-electric transducer having a selectively adjustable air gap may have a selectively adjustable frequency response, which may ensure, or at least facilitate, good audio quality irrespective of the acoustic environment in which it is used.

The expression "transversely outwards" is intended to mean that the air gap is provided between the outer boundary of the diaphragm and the cavity and extends substantially in the same plane as the diaphragm or in a plane substantially parallel thereto. If the diaphragm is a flat circular disc for example the air gap may be provided radially outwards of the diaphragm in the same plane as the diaphragm. The diaphragm may be of any shape and cross-section, e.g., it need not necessarily be flat.

According to an embodiment, the acoustic-electric transducer may include a signal processing unit that may be arranged to analyze the frequency content of at least part of an acoustic signal and the actuator may be arranged to adjust the size of the air gap if/when the acoustic signal contains more than a predetermined amount of a component within a predetermined frequency range. Alternatively, or additionally, a signal processing unit may be arranged to analyze the frequency content of at least part of an acoustic signal and the actuator may be arranged to adjust the size of the air gap if/when the acoustic signal contains less than a predetermined amount of a component within a predetermined frequency range.

The size of the air gap and the frequency response of the acoustic-electric transducer may therefore be adjusted if there is an abnormal level of a component within a predetermined frequency, for example more than the amount of that component in the human voice. If/when the amount of that component returns to a normal level, the frequency response of the acoustic-electric transducer may again be adjusted accordingly to ensure that the acoustic-electric transducer has a suitable frequency response for the acoustic environment in which it is being used.

According to another embodiment, the actuator may be arranged to adjust the size of the air gap if if/when the acoustic signal contains more than a predetermined amount of a low frequency component, e.g., a component having a frequency of up to 600 Hz. According to a further embodiment, the actuator may be arranged to increase the size of the air gap if/when more than a predetermined amount of a low frequency component is detected by the signal processing unit.

If a microphone is used outdoors on a windy day for example, the size of the air gap may be increased to give the microphone a high pass response in order to remove the low frequency component, the amount of which may be increased due to wind blowing into the microphone. The low frequency part of a user's voice may, in such a situation, be removed but the overall sound quality may be increased. A higher signal to noise ratio may be possible as the gain in a subsequent amplifier stage can be increased without risk of saturation of the microphone's amplifier. Once a user takes the microphone indoors, the amount of low frequency component may decrease to a normal amount, whereby the size of the air gap may be decreased to improve the sensitivity of the microphone in the low frequency region.

According to an embodiment, the actuator may comprise electroactive material, such as an electroactive polymer (EAP) and/or a piezoelectric material, such as polyvinylidene fluoride (or PVDF, also known as KYNAR, HYLAR or SYGEF) which may change shape/size or moves when stimulated with electrically.

Electroactive polymers, or EAPs, are polymers whose shape/size may be modified when a voltage is applied to them.

As actuators, they can undergo a large amount of deformation while sustaining large forces. In dielectric EAPs, such as electrostrictive polymers and dielectric elastomers, actuation may be caused by electrostatic forces between two electrodes located on each side of the EAP which squeeze the EAP therebetween. No power may be required to keep the EAP actuator at a given position.

Piezoelectricity is the ability of some materials (e.g., crystals and certain ceramics) to generate an electric potential in response to applied mechanical stress. This may take the form of a separation of electric charge across the crystal lattice. If the material is not short-circuited, the applied charge may induce a voltage across the material. The piezoelectric effect may be reversible in that materials exhibiting the direct piezoelectric effect (the production of electricity when stress is applied) also exhibit the converse piezoelectric effect (the production of stress and/or strain when an electric field is applied). Piezoelectric materials may namely exhibit a shape change in response to an applied electric field.

According to another embodiment, the actuator may be arranged between the outermost boundary of the diaphragm and the cavity wall/walls. The actuator may, however, be arranged in any location in which it can directly or indirectly change the size of the air gap. The wall/walls of the cavity may themselves constitute at least part of an actuator. At least part of the wall/walls of the cavity may for example comprise an electroactive material.

According to a further embodiment, the actuator may be arranged to allow the size of the air gap to be infinitely (e.g., continuously) variable or to be variable in a step-wise manner. The size of the air gap may for example be arranged to be varied continuously during periods when the acoustic-electric transducer is in use. Alternatively, the acoustic-electric transducer may comprise a switch that may be activated by a user to select a particular frequency response or to initiate the selection of a optimum air gap size and consequently an optimum frequency response for a particular acoustic environment.

According to an embodiment, the size of the air gap may be arranged to vary from 0 up to 10 μm, e.g., an air gap may be arranged to close completely; preferably within the range of 1-7 μm (micrometers).

According to another embodiment, the microphone containing such an acoustic-electric transducer may be a micro-electrical-mechanical system (MEMS) microphone. In a MEMS microphone (also called a microphone chip or silicon microphone) a pressure-sensitive diaphragm may be etched directly into a silicon chip by MEMS techniques, and may also comprise an integrated preamplifier. MEMS microphones may comprise built in analog-to-digital converter (ADC) circuits on the same complementary metal oxide semiconductor (CMOS) chip making the chip a digital microphone and so more readily integrated with digital products, such as cellular telephones. An acoustic-electric transducer according to one embodiment may therefore be easily realized using MEMS technology, using a combination of photolithography, silicon deep reactive ion etching and wet chemical etching for example.

One or more embodiments may also relate to an electronic device that may include an acoustic-electric transducer according to any of the embodiments. The electronic device may be a portable or non-portable device, such as a telephone, media player, Personal Communications System (PCS) terminal, Personal Data Assistant (PDA), laptop computer, palmtop receiver, camera, television, radar or any appliance that may include an acoustic-electric transducer designed to transmit and/or receive acoustic signals. The acoustic-electric transducer and electronic device according to one or more embodiments are, however, intended for use particularly, but not exclusively for high frequency radio equipment.

One or more embodiments may further relate to a method for changing the frequency response of an acoustic-electric transducer comprising a cavity delimited by a wall/walls and having an opening and a diaphragm having an outer boundary, the diaphragm being arranged to extend across the opening so that an air gap may be provided transversely outwards of the diaphragm between the outer boundary of the diaphragm and the cavity wall/walls. The method may comprise providing an air gap around the diaphragm of an acoustic electric transducer and adjusting the size of the air gap while the acoustic-electric transducer is in use, e.g., the method may exclude some or all acoustic optimizations that may be undertaken by a manufacturer of an acoustic-electric transducer comprising a non-adjustable air gap to determine the optimum size of the non-adjustable air gap.

According to an embodiment, the method may include analyzing the frequency content of at least part of an acoustic signal and adjusting the size of the air gap if/when the acoustic signal contains more than a predetermined amount of a component within a predetermined frequency range.

According to an embodiment, the method may comprise analyzing the frequency content of at least part of an acoustic signal and adjusting the size of the air gap if/when the acoustic signal contains less than a predetermined amount of a component within a predetermined frequency range.

According to another embodiment, the method may comprise applying a voltage and/or changing the voltage applied to an actuator comprising electroactive material, such as an electroactive polymer (EAP) and/or a piezoelectric material in order to adjust the size of the air gap.

One or more embodiments may also relate to a computer program product that may include a computer program containing computer program code means arranged to cause a computer or a processor to execute the steps of a method according to any of the embodiments, stored on a computer-readable medium.

Further embodiments of the method are provided in the appended claims.

BRIEF DESCRIPTION OF THE DRAWINGS

Embodiments will hereinafter be further explained by means of non-limiting examples with reference to the appended schematic figures where.

The drawings have not been drawn to scale and that the dimensions of certain features have been exaggerated for the sake of clarity.

DETAILED DESCRIPTION

It is know that if a microphone comprises an open cavity and a diaphragm arranged to extend across the cavity opening, with an air gap that is arranged transversely outwards of the diaphragm between the outer boundary of the diaphragm and the cavity wall/walls, sound waves can enter the cavity, the sound pressure inside the cavity may therefore be changed and the microphone's frequency response may consequently be changed.

The provision of an air gap at the edge of a diaphragm may therefore change the frequency response of the microphone. The air gap may namely alter the low frequency characteristics of the microphone and give it a high pass frequency response, which may improve its performance when it is used outdoors on a windy day, for example.

Unfortunately, that which is an optimum frequency response for one acoustic environment may not be an optimum frequency response for another acoustic environment. A cellular telephone comprising a microphone may namely be used in several different environments, such as in a factory setting, then in a vehicle, and subsequently in a quiet indoor office or home. It may be difficult, therefore, to provide a cellular telephone with a microphone having a frequency response that is optimal for acoustic environments in which it may be used due to the varying level and type of background noise that it may encounter when it is in use.

Figure 1:
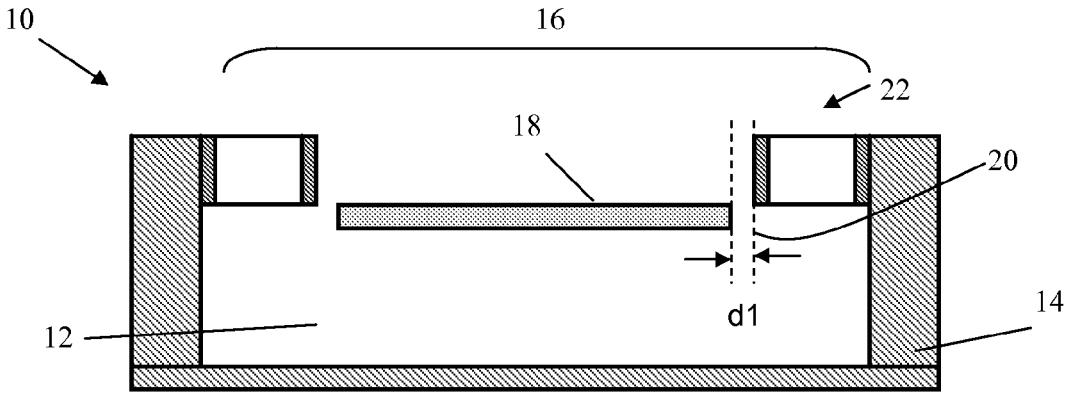
FIGS. 1 & 2 show an exemplary acoustic-electric transducer according to an embodiment.
Figure 2:
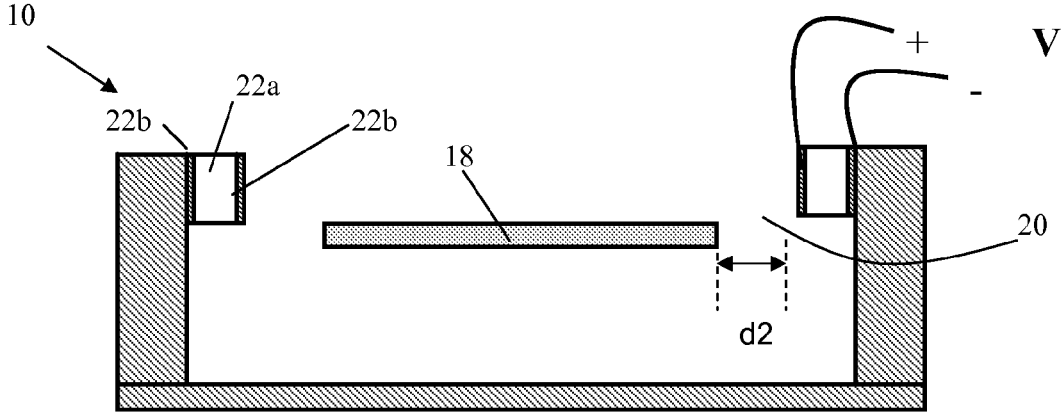
Figure 3:
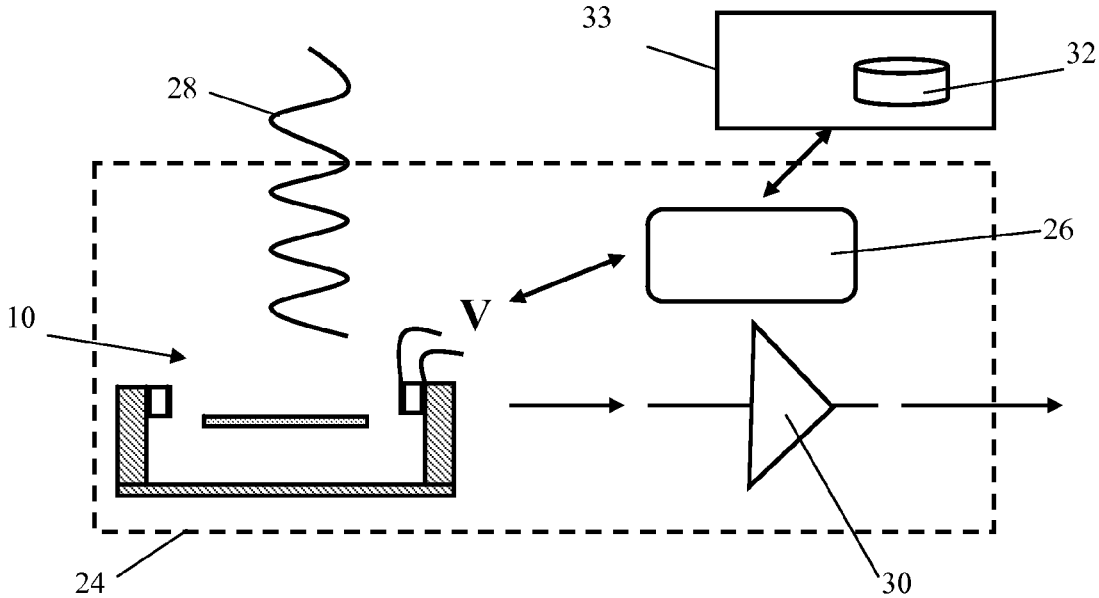
FIG. 3 shows an exemplary microphone according to an embodiment.

FIG. 1 shows an acoustic-electric transducer 10 according to one embodiment. The acoustic-electric transducer 10 may include a cavity 12 delimited by walls 14 and having an opening 16. The cavity walls 14 may themselves comprise one or more holes or openings (of an adjustable or non-adjustable size) or they may be free of holes or openings (as shown in FIGS. 1-3). The acoustic-electric transducer 10 may also include a diaphragm 18, which, in the illustrated embodiment, is shown as a flat circular disc, which is resiliently mounted on the cavity walls 12 or some other component of a microphone by means of springs or elastic hose connections (not shown), for example.

The diaphragm 18 is arranged to extend across the opening 16 so that an air gap 20 is provided radially outwards of the diaphragm 18 between the outer boundary of the diaphragm 18 and the walls 14 of the cavity 12, whereby the air gap 20 substantially surrounds the periphery of the diaphragm 18. According to one embodiment, the diaphragm has a maximum transverse extension, e.g., a diameter, if the diaphragm 18 is circular, up to five millimeters. In one embodiment, the diameter may be up to 1 mm. For example, the diameter of a diaphragm 18 may be 0.7 mm.

An air gap 20 in any of the embodiments need not necessarily surround the entire outer boundary of a diaphragm 18. Furthermore, an air gap 20 need not necessarily be a single air gap but may comprise a plurality of air gaps, separated by means to mount a diaphragm to a cavity wall 12, for example.

The acoustic-electric transducer 10 may further include an actuator 22 that is arranged to adjust the size of the air gap 20. The actuator 22, which, in the illustrated embodiment, is in the form of a ring that is arranged around the periphery of the diaphragm 18, adjacent to the cavity walls 12. The actuator 22 may include an electroactive material 22*a*, which may be sandwiched between two compliant electrodes 22*b* comprising electrically conducting particles, such as carbon particles, in an elastomeric matrix, for example. The thickness of the electroactive material 22*a* between the electrodes 22*b*, and consequently the size of the air gap 20 and the frequency response of the acoustic-electric transducer 10, may be adjusted by varying the voltage, V, applied to the electrodes 22*b* of the actuator 22. The electroactive material 22*a* may be arranged to contract on application of a voltage V across the electrodes 22*b*, causing the thickness of the electroactive material 22*a* to decease and, in one embodiment, its area to increase so as to maintain the same volume. The electroactive material 22*b* may, however, be arranged so as to undergo a volume change on application of a voltage V across the electrodes 22*b*.

The acoustic-electric transducer 10 is arranged to change the size of the air gap 20 from d1 to d2 when the acoustic-electric transducer 10 is used outdoors, for example, via the activation of a switch by a user. Air gap adjustment may be initiated by a control signal generated inside an electronic device containing the acoustic-electric transducer 10 or externally thereto, on request and/or automatically, on detection of an acoustic environment requiring modification of the frequency response of the acoustic-electric transducer 10.

Different arrays of electrodes 22*b* may be used to create more complex motion, other than simple linear motion of the electroactive material 22*a*. The same actuator may be used to adjust the shape/size of more than one air gap. Furthermore, a composite comprising a particular electroactive material may be used rather than only that electroactive material, in order to lower the activation voltage.

FIG. 3 shows an exemplary microphone 24 comprising the acoustic-electric transducer 10 shown in FIGS. 1 and 2, a signal processing unit 26 that is arranged to analyze the frequency content of at least part of an acoustic signal 28 that enters the microphone 24 and an amplifier 30, such as a field effect transistor (FET) amplifier. The acoustic-electric transducer 10 may include an actuator 22 that is arranged to adjust the size of the air gap 20 if/when the acoustic signal 28 contains more than a predetermined amount of a low frequency component, such as a component having a frequency of 300-600 Hz.

The actuator 22 may be arranged to increase the size of the air gap 20 (e.g., from d1 to d2) if/when more than a predetermined amount of a low frequency component is detected by the signal processing unit 26. The size of the air gap 20 can, for example, be arranged to vary from 0 μm up to 10 μm, preferably within the range of 1-7 μm in a step-wise or non-step-wise manner.

FIG. 3 also shows that the exemplary microphone may comprise or be in communication with a computer program product 33 that is arranged to change the shape and/or size of the microphone's air gap 20, and thus its frequency response depending on the results of the signal processing unit's analyses. The computer program product may comprise a database 32 that stores information concerning the optimum air gap size for a particular acoustic environment as detected by a signal processing unit 26 or as determined by a user.

Figure 4:
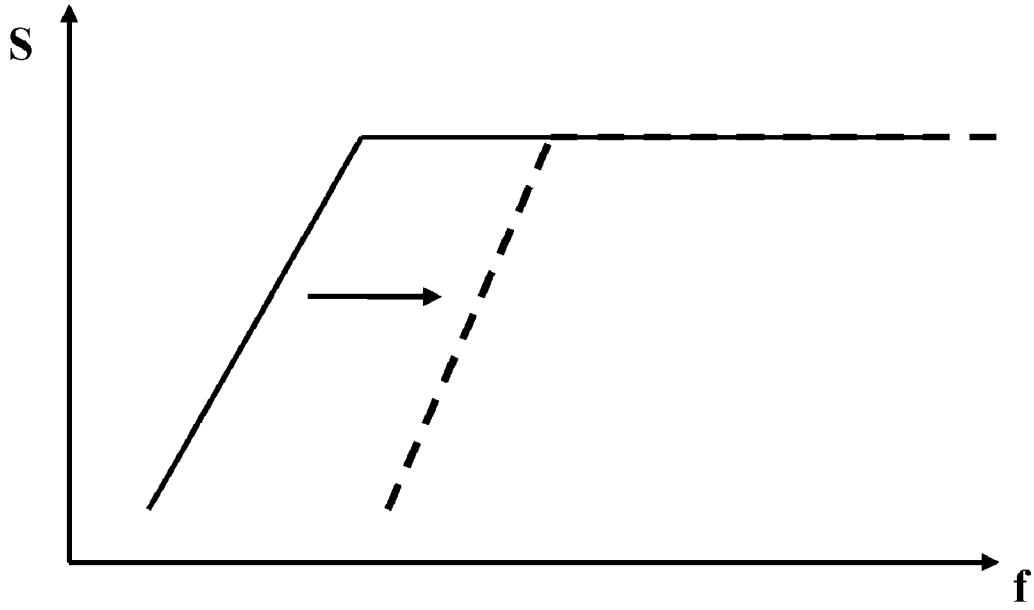
FIGS. 4 & 5 show the frequency response of an exemplary microphone according to one embodiment for different air gap sizes.

FIG. 4 schematically shows the sensitivity (S) of an exemplary microphone to audio signals of different frequencies (f) when the size of its air gap is 1 μm and when the size of its air gap is 7 μm. It can be seen that an increase in the size of the air gap may change the frequency response of the microphone.

Figure 5:
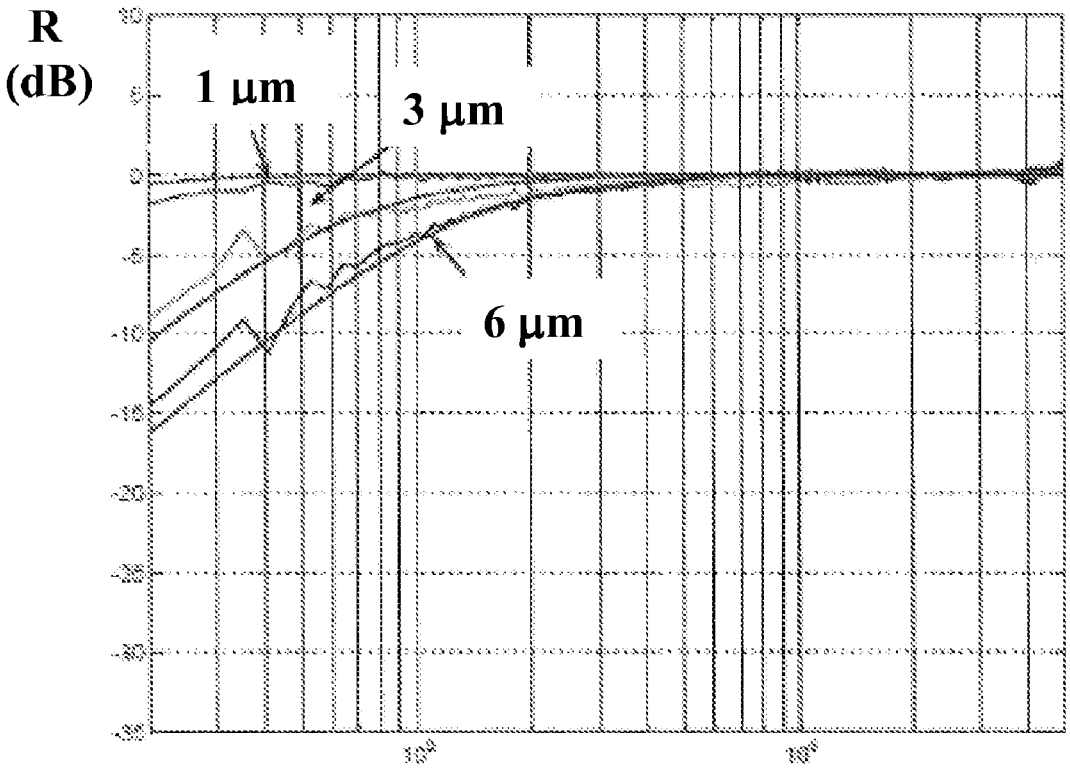

FIG. 5 shows the frequency response (R) of an exemplary microphone for three different gap sizes, namely 1, 3 and 6 μm. The greater the size of the air gap, the lesser the amount of low frequency noise that may be amplified or recorded by the microphone.

Figure 6:
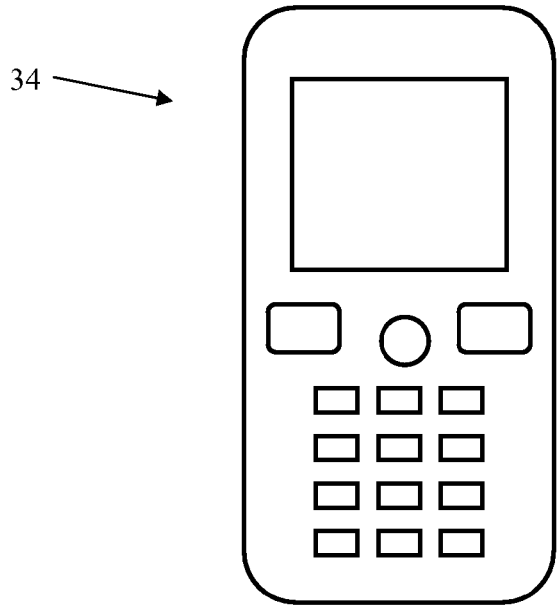
FIG. 6 shows an exemplary electronic device according to an embodiment.

FIG. 6 shows an exemplary electronic device 34, e.g., a mobile telephone, comprising an acoustic-electric transducer 10 according to any of the embodiments.

Figure 7:
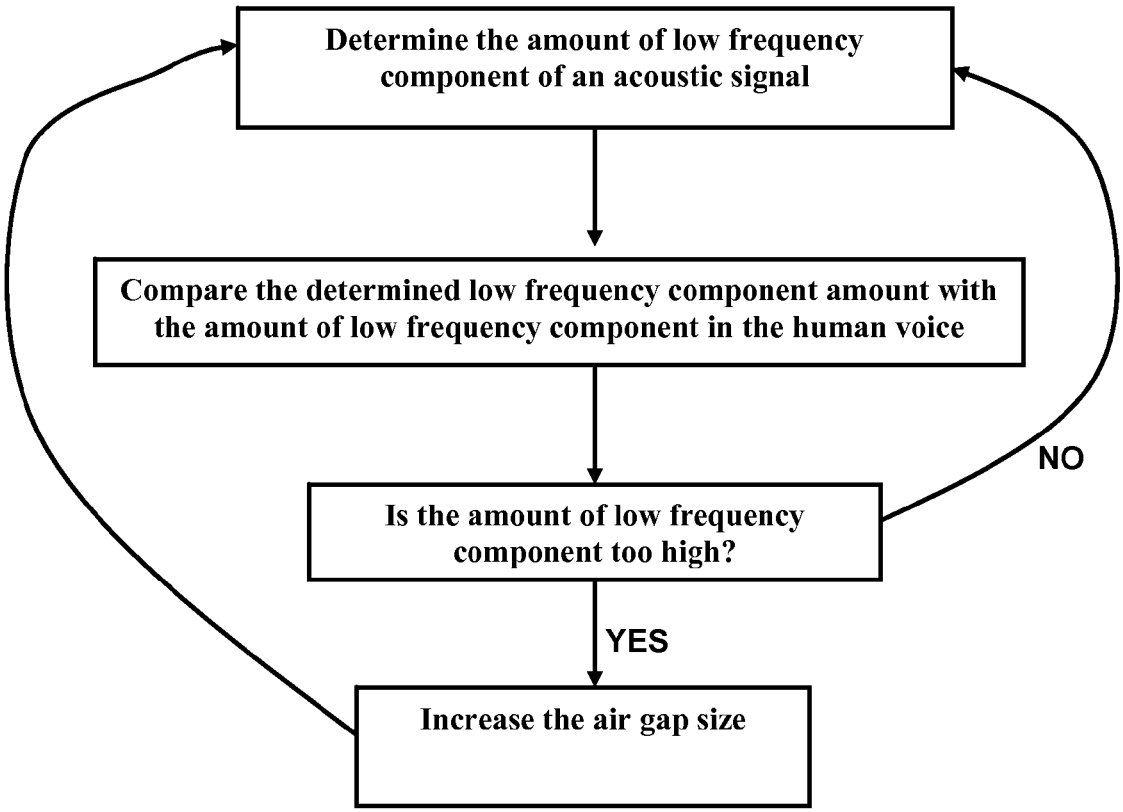
FIG. 7 is a flowchart showing an exemplary process according to an embodiment.

FIG. 7 is a flowchart showing an exemplary process according to an embodiment.

The method may comprise determining the amount of low frequency component in an acoustic signal entering a microphone, and comparing the determined amount with the normal low frequency component in the human voice. If the amount of low frequency component is too high, the air gap size may be increased. The process may be repeated immediately or after a predetermined time. If the amount of low frequency component is within a desired range, the air gap size may not be adjusted, whereupon the method may then be repeated, immediately or after a predetermined time.

Further modifications of the described embodiments within the scope of the claims would be apparent to a skilled person. Even though the appended claims are directed to adjusting the size of an air gap at a particular location in an acoustic-electric transducer, embodiments are applicable to adjusting the size of any gap, hole or opening in an acoustic-electric transducer, which affects its acoustic characteristics.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

While series of blocks have been described above, such as with respect to FIG. 7, the order of the blocks may differ in other implementations. Moreover, non-dependent blocks may be implemented in parallel.

It will be apparent that aspects of the embodiments, as described above, may be implemented in many different forms of software, firmware, and hardware in the implementations illustrated in the figures. The actual software code or specialized control hardware used to implement these embodiments is not limiting of the invention. Thus, the operation and behavior of the embodiments of the invention were described without reference to the specific software code—it being understood that software and control hardware may be designed to the embodiments based on the description herein.

Further, certain portions of the invention may be implemented as "logic" that performs one or more functions. This logic may include hardware, such as an application specific integrated circuit, a field programmable gate array, a processor, or a microprocessor, software, or a combination of hardware and software.

The term "comprises/comprising" when used in this specification is taken to specify the presence of stated features, integers, steps or components but does not preclude the presence or addition of one or more other features, integers, steps, components or groups thereof.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A method comprising:

receiving an acoustic signal in an acoustic-electric transducer in a microphone, the transducer comprising a cavity delimited by a wall and having an opening and a diaphragm having an outer boundary, said diaphragm being arranged to extend across said opening so that an air gap is provided transversely outwards of the diaphragm between said outer boundary of said diaphragm and said cavity wall;

analyzing a component of a frequency content of at least part of the acoustic signal; and adjusting a size of the air gap when the component of the frequency content based on the component of the frequency content.

2. The method according to claim 1, where the component of the frequency content is a low frequency content or where the component of the frequency content is less than 600 Hz, and where adjusting the size of the air gap comprises adjusting the size of said air gap when the component of the frequency content is more than a threshold amount.

3. The method according to claim 1, where the component of the frequency content is a low frequency component and where adjusting the size of the air gap comprises adjusting the size of said air gap when the low frequency component is less than a threshold amount.

4. The method according to claim 1, further comprising applying a voltage or changing the voltage applied to an actuator, the actuator comprising one or more of an electroactive material, an electroactive polymer (EAP), or a piezoelectric material, in order to adjust the size of said air gap.

5. The method according to claim 1, further comprising adjusting the size of said air gap in a continuously variable manner.

6. The method according to claim 1, further comprising adjusting the size of said air gap in a step-wise manner.

7. The method according to any of claim 6, further comprising varying the size of said air gap from 0 to 10 μm or from 1 to 7 μm.

8. A portable electronic device, comprising:

a microphone including a transducer, the transducer comprising a cavity delimited by a wall and having an opening;

a diaphragm having an outer boundary, said diaphragm extending across said opening and forming an air gap between the outer boundary of the diaphragm and the cavity wall;

a signal processor to analyze a component of a frequency content of a portion of an acoustic signal; and an actuator to adjust a size of said air gap in response to the frequency content of the portion of the acoustic signal, where the component of the frequency content is a low frequency component, and where the actuator increases or decreases the size of the gap based on the low frequency component.

9. An acoustic-electric transducer for a microphone, comprising:

a cavity delimited by a wall and having an opening;

a diaphragm having an outer boundary, said diaphragm extending across said opening so that an air gap is provided transversely outwards of the diaphragm between said outer boundary of said diaphragm and said cavity wall;

an actuator configured to adjust a size of said air gap;

where said microphone comprises a signal processor to analyze a component of a frequency content of at least part of an acoustic signal, and where the actuator is to adjust the size of the air gap when the component of the frequency content is greater than a threshold amount or when the component of the frequency content is less than the threshold amount.

10. The acoustic-electric transducer according to claim 9, where the component of the frequency content is a low frequency component or the component of the frequency content is less than 600 Hz.

11. The acoustic-electric transducer according to claim 10, where said actuator is arranged to increase the size of said air gap when the low frequency component of the frequency content is greater than the threshold amount.

12. The acoustic-electric transducer according to claim 9, where said actuator comprises one or more of an electroactive material, an electroactive polymer (EAP), or a piezoelectric material.

13. The acoustic-electric transducer according to claim 9, where said actuator is configured between said outermost boundary of said diaphragm and said cavity wall.

14. The acoustic-electric transducer according to claim 9, where said actuator is configured to allow the size of said air gap to be continuously variable.

15. The acoustic-electric transducer according to claim 9, where said actuator is configured to adjust the size of said air gap in a step-wise manner.

16. The acoustic-electric transducer according to claim 9, where the size of said air gap is configured to vary between one or more of 0 μm and 10 μm or 1 μm and 7 μm.

17. The acoustic-electric transducer according to claim 9, where said microphone comprises a micro-electrical-mechanical system (MEMS) microphone.

* * * * *

UNITED STATES PATENT AND TRADEMARK OFFICE

CERTIFICATE OF CORRECTION

PATENT NO. : 8,081,782 B2
APPLICATION NO. : 12/121555
DATED : December 20, 2011
INVENTOR(S) : Klinghult It is certified that error appears in the above-identified patent and that said Letters Patent is hereby corrected as shown below:

(Column 8, line 8) after "component", insert a --,--

Signed and Sealed this
Thirteenth Day of March, 2012

David J. Kappos

David J. Kappos
*Director of the United States Patent and Trademark Office*